US009122214B2

(12) United States Patent
Matsumoto et al.

(10) Patent No.: US 9,122,214 B2
(45) Date of Patent: Sep. 1, 2015

(54) FIXING DEVICE AND IMAGE FORMING APPARATUS

(71) Applicant: FUJI XEROX CO., LTD., Minato-ku, Tokyo (JP)

(72) Inventors: Mitsuhiro Matsumoto, Kanagawa (JP); Hideaki Ohara, Kanagawa (JP); Nobuyoshi Komatsu, Kanagawa (JP); Yasuhiro Uehara, Kanagawa (JP); Kazuyoshi Ito, Kanagawa (JP); Mikio Saiki, Kanagawa (JP); Hiromi Nagai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/280,783

(22) Filed: May 19, 2014

(65) Prior Publication Data

US 2015/0098737 A1 Apr. 9, 2015

(30) Foreign Application Priority Data

Oct. 3, 2013 (JP) ..... 2013-208658

(51) Int. Cl.
*G03G 15/20* (2006.01)

(52) U.S. Cl.
CPC ..... *G03G 15/2053* (2013.01); *G03G 15/2089* (2013.01); *G03G 2215/2016* (2013.01); *G03G 2215/2032* (2013.01); *G03G 2215/2035* (2013.01)

(58) Field of Classification Search
CPC ..... G03G 15/20
USPC ..... 399/329, 328
See application file for complete search history.

(56) References Cited

U.S. PATENT DOCUMENTS

| | | | | |
|---|---|---|---|---|
| 2003/0063931 | A1* | 4/2003 | Sanpei et al. | 399/328 |
| 2010/0303525 | A1* | 12/2010 | Mitsuoka et al. | 399/329 |
| 2011/0217095 | A1* | 9/2011 | Ishii et al. | 399/329 |
| 2012/0093546 | A1* | 4/2012 | Ohara et al. | 399/329 |
| 2014/0153983 | A1* | 6/2014 | Fujii et al. | 399/329 |
| 2015/0098737 | A1* | 4/2015 | Matsumoto et al. | 399/329 |

FOREIGN PATENT DOCUMENTS

JP 2011-180502 A 9/2011

* cited by examiner

*Primary Examiner* — Clayton E Laballe
*Assistant Examiner* — Kevin Butler
(74) *Attorney, Agent, or Firm* — Sughrue Mion, PLLC

(57) ABSTRACT

Provided is a fixing device including a fixing member that fixes a toner image onto a recording material, a pressurizing member that forms a pressurizing portion, in cooperation with the fixing member, through which the recording material holding a non-fixed toner image passes, a heating member that includes a heat generating portion having a predetermined pattern shape and being energized to generate heat, and heats the fixing member, a supporting member that supports the heating member along an inner circumferential surface of the fixing member, and a thermal diffusion member that faces the supporting member with interposing the heating member, and diffuses heat from the heating member and conducts the heat to the fixing member.

7 Claims, 9 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2013-208658 filed Oct. 3, 2013.

BACKGROUND (i) Technical Field

The invention relates to a fixing device and an image forming apparatus.

(ii) Related Art

In the related art, a fixing device that applies heat via a fixing member to a recording material where a toner image is formed and fixes the toner image onto the recording material is known.

SUMMARY

According to an aspect of the invention, there is provided a fixing device including:

a fixing member that fixes a toner image onto a recording material;

a pressurizing member that forms a pressurizing portion, in cooperation with the fixing member, through which the recording material holding a non-fixed toner image passes;

a heating member that includes a heat generating portion having a predetermined pattern shape and being energized to generate heat, and heats the fixing member;

a supporting member that supports the heating member along an inner circumferential surface of the fixing member; and a thermal diffusion member that faces the supporting member with interposing the heating member, and diffuses heat from the heating member and conducts the heat to the fixing member.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described in detail with reference to the accompanying drawings.

Description of Image Forming Apparatus

Figure 1:
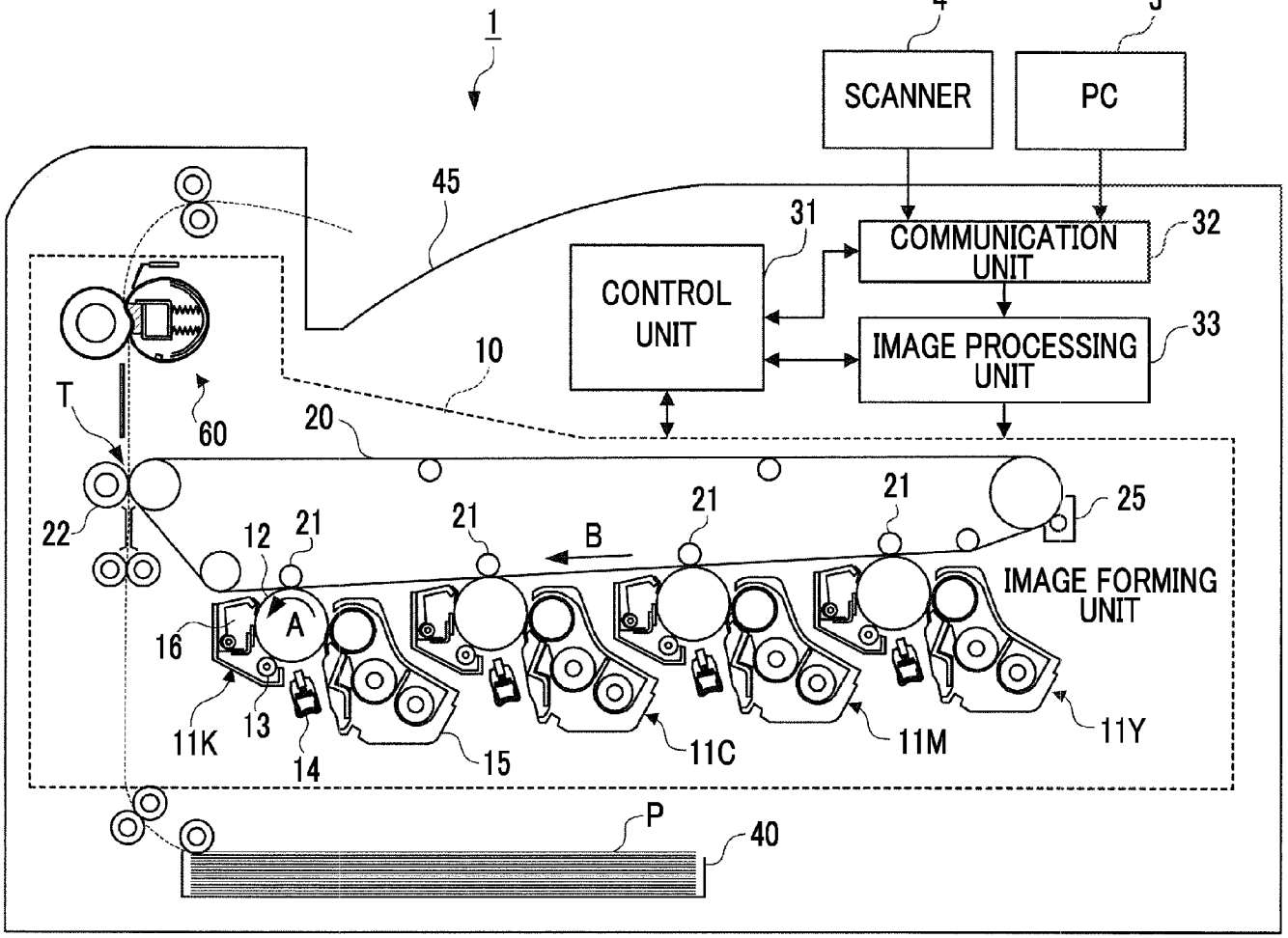
FIG. 1 is a diagram illustrating a configuration example of an image forming apparatus to which a fixing device according to this exemplary embodiment is applied.

FIG. 1 is a diagram illustrating a configuration example of an image forming apparatus to which a fixing device according to this exemplary embodiment is applied. An image forming apparatus 1 illustrated in FIG. 1 is a so-called tandem type color printer, and includes an image forming unit 10 that forms an image based on image data, and a control unit 31 that controls an operation of the entire image forming apparatus 1. The image forming apparatus 1 further includes a communication unit 32 that receives the image data by communicating with, for example, a personal computer (PC) 3 and an image reader (scanner) 4, and an image processing unit 33 that performs predetermined image processing on the image data which is received by the communication unit 32.

The image forming unit 10 has four image forming units 11Y, 11M, 11C, and 11K (collective referred to also as "image forming units 11") that are arranged in parallel at predetermined gaps as an example of toner image forming units. Each of the image forming units 11 has a photoconductor drum 12 that forms an electrostatic latent image and holds a toner image, a charging unit 13 that charges an outer surface of the photoconductor drum 12 with a predetermined potential, a light emitting diode (LED) print head 14 that exposes the photoconductor drum 12 which is charged by the charging unit 13 based on the image data of each color, a developing unit 15 that develops the electrostatic latent image which is formed on the photoconductor drum 12, and a drum cleaner 16 that cleans the outer surface of the photoconductor drum 12 after transfer.

Each of the image forming units 11 has a substantially similar configuration to one another except for toner that is accommodated in the developing unit 15. The image forming units 11 respectively form the yellow (Y), magenta (M), cyan (C), and black (K) toner images.

The image forming unit 10 further includes an intermediate image transfer belt 20 where the toner images of the respective colors, which are formed on the photoconductor drums 12 of the respective image forming units 11, are subjected to multiple transfer, and primary image transfer rollers 21 that sequentially transfer (primary image transfer) the toner images of the respective colors, which are formed by the respective image forming units 11, to the intermediate image transfer belt 20. The image forming unit 10 further includes a secondary image transfer roller 22 that collectively transfers (secondary image transfer) the toner images of the respective colors, which are superposed and transferred on the intermediate image transfer belt 20, to a sheet Pas a recording material (recording paper), and a fixing unit 60 as an example of a fixing device that fixes the secondary image-transferred toner images of the respective colors onto the sheet P. In the image forming apparatus 1 according to this exemplary embodiment, the intermediate image transfer belt 20, the primary image transfer roller 21, and the secondary image transfer roller 22 constitute a transfer portion.

In the image forming apparatus 1 according to this exemplary embodiment, image forming processing based on the following process is performed amid an operation control by the control unit 31. The image data from the PC 3 and the scanner 4 are received by the communication unit 32, and is sent to each of the image forming units 11 after being subjected to the predetermined image processing by the image processing unit 33 and then divided into the image data of each of the colors. Then, in the image forming unit 11K that forms the black (K) toner image for example, the predetermined potential is charged by the charging unit 13 while the photoconductor drum 12 rotates in an arrow A direction, and the LED print head 14 performs scanning exposure on the photoconductor drum 12 based on the image data of the K color transmitted from the image processing unit 33. In this manner, the electrostatic latent image relating to the K color image is formed on the photoconductor drum 12. The electrostatic latent image of the K color that is formed on the photoconductor drum 12 is developed by the developing unit 15, and the K color toner image is formed on the photoconductor drum 12. Likewise, the yellow (Y), the magenta (M) and the cyan (C) color toner images are respectively formed in the image forming units 11Y, 11M, and 11C.

The toner images of the respective colors that are formed on the photoconductor drums 12 of the respective image forming units 11 are subjected to sequential electrostatic transfer (primary image transfer), by the primary image transfer roller 21, on the intermediate image transfer belt 20 that moves in an arrow B direction, and superposed toner images where the toner of the respective colors are superposed are formed. The superposed toner images on the intermediate image transfer belt 20 are transported to an area (secondary image transfer portion T) where the secondary image transfer roller 22 is arranged due to the movement of the intermediate image transfer belt 20. The sheet P is supplied from a sheet holding portion 40 to the secondary image transfer portion T at a timing when the superposed toner images are transported to the secondary image transfer portion T. The superposed toner images are subjected to collective electrostatic transfer (secondary image transfer) on the transported sheet P by a transfer field that is formed in the secondary image transfer portion T by the secondary image transfer roller 22.

Then, the sheet P, where the superposed toner images are electrostatically transferred, is transported to the fixing unit 60. The toner image on the sheet P that is transported to the fixing unit 60 receives heat and pressure from the fixing unit 60 and is fixed onto the sheet P. Then, the sheet P, where the fixed image is formed, is transported to a sheet stacking member 45 that is disposed in a discharge unit of the image forming apparatus 1.

The toner (toner remaining after the primary image transfer) adhering to the photoconductor drum 12 after the primary image transfer and the toner (toner remaining after the secondary image transfer) adhering to the intermediate image transfer belt 20 after the secondary image transfer are respectively removed by the drum cleaner 16 and a belt cleaner 25.

In this manner, the image forming processing in the image forming apparatus 1 is repeatedly performed for cycles equivalent to the number of prints.

Description of Configuration of Fixing Unit

Next, the fixing unit 60 of this exemplary embodiment will be described.

Figure 2:
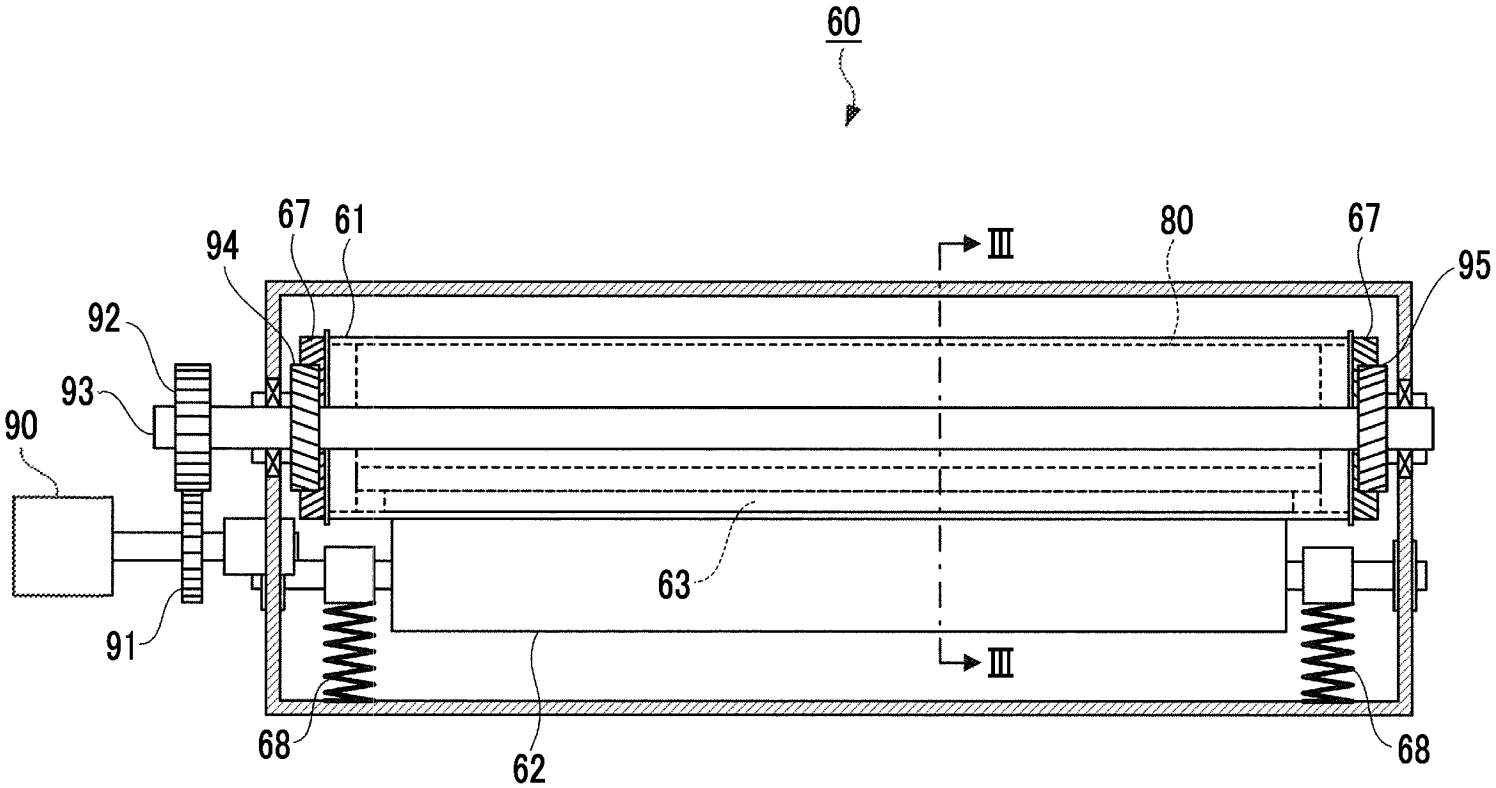
FIG. 2 is a front view illustrating a configuration of a fixing unit according to this exemplary embodiment.
Figure 3:
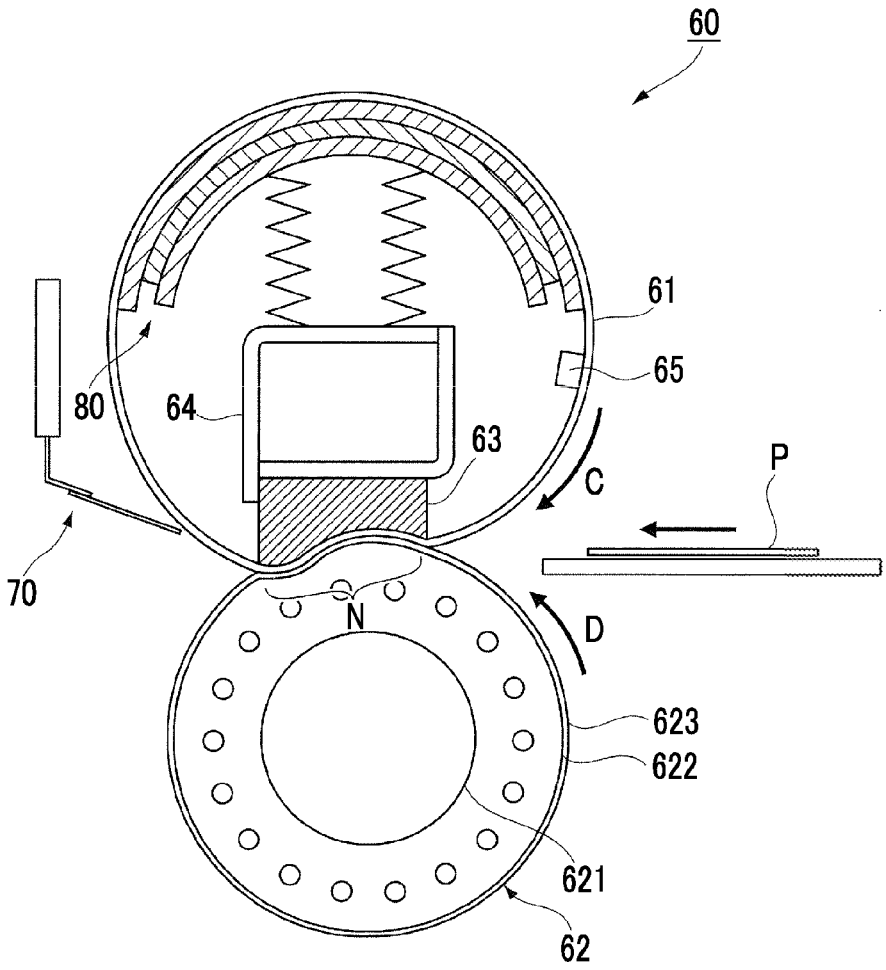
FIG. 3 is a sectional diagram taken along line III-III of FIG. 2.

FIGS. 2 and 3 are diagrams illustrating a configuration of the fixing unit 60 according to this exemplary embodiment. FIG. 2 is a front view, and FIG. 3 is a sectional diagram taken along line of FIG. 2.

As illustrated in FIG. 3, which is a sectional diagram, the fixing unit 60 has a heater unit 80 as a heating source, a fixing belt 61 as an example of a fixing member that is heated by the heater unit 80 to fix the toner image, a pressurizing roller 62 as an example of a pressurizing member that is arranged to face the fixing belt 61, and a pressing pad 63 that is pressed from the pressurizing roller 62 via the fixing belt 61.

The fixing unit 60 further has a frame 64 that supports components such as the pressing pad 63, a temperature sensor 65 that contacts with an inner circumferential surface of the fixing belt 61 to measure the temperature of the fixing belt 61, and a separation assist member 70 that assists in separation of the sheet P from the fixing belt 61.

Description of Fixing Belt

Figure 4:
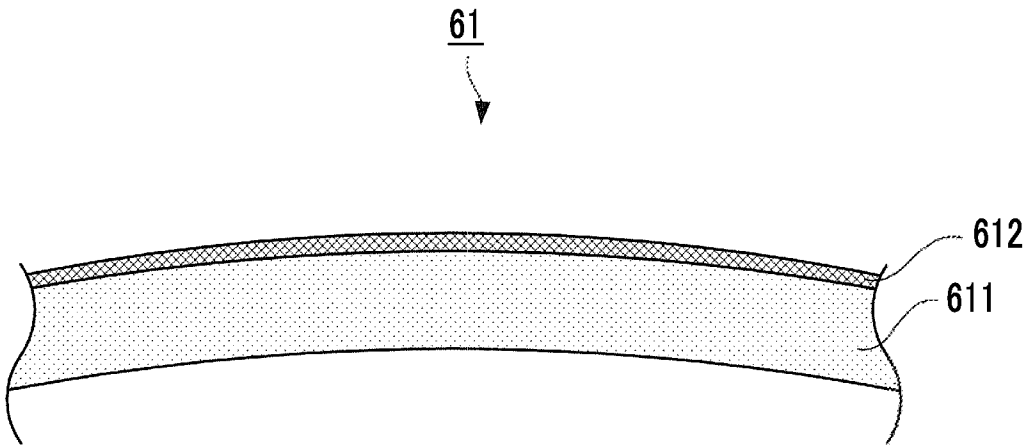
FIG. 4 is a sectional layer configuration diagram of a fixing belt.

The fixing belt 61 is an endless belt member with a cylindrical original shape, and is formed to have, for example, a diameter of 30 mm and a length of 300 mm in a width direction in the original shape (cylindrical shape). In addition, as illustrated in FIG. 4 (sectional layer configuration diagram of the fixing belt 61), the fixing belt 61 is a belt member that has a structure formed from a base material layer 611 and a release layer 612 coated on the base material layer 611.

The base material layer 611 is a heat-resistant sheet-shaped member that forms mechanical strength of the entire fixing belt 61.

A sheet that has a thickness of 60 μm to 200 μm and is formed of a polyimide resin is used as an example of the base material layer 611. In addition, a heat conductive filler formed of aluminum oxide and the like may be contained in a polyimide resin sheet for uniform temperature distribution of the fixing belt 61.

The release layer 612 directly contacts with a non-fixed toner image held on the sheet P and thus a material with high release properties is used therein. Examples thereof include a tetrafluoroethylene perfluoroalkyl vinyl ether copolymer (PFA), polytetrafluoroethylene (PTFE), a silicone copolymer, and a composite layer thereof. When the release layer 612 is excessively thin in thickness, wear resistance becomes insufficient and the life of the fixing belt 61 is shortened. When the release layer 612 is excessively thick, the heat capacity of the fixing belt 61 becomes excessively large and the warm-up time is lengthened. Allowing for a balance between the wear resistance and the heat capacity, it is desirable that the thickness of the release layer 612 be 1 μm to 50 μm.

It is preferable that an elastic layer that is configured to contain a heat-resistant elastomer such as silicone rubber be disposed between the base material layer 611 and the release layer 612 of the fixing belt 61 when a color image is formed by the image forming unit 10 (refer to FIG. 1). Compared to when this configuration is not adopted, fixing properties of the color image may be improved when such an elastic layer is disposed in the fixing belt 61.

Description of Driving Mechanism of Fixing Belt

Next, a driving mechanism of the fixing belt 61 will be described.

As illustrated in FIG. 2, which is a front view, end cap members 67 that drive the fixing belt 61 to rotate in a circumferential direction while maintaining circular sectional shapes of both end portions of the fixing belt 61 are fixed to both end portions of the frame 64 (refer to FIG. 3) in an axial direction. The fixing belt 61 directly receives a rotating driving force from both of the end portions via the end cap members 67, and is rotatingly moved in an arrow C direction in FIG. 3 at a process speed of, for example, 140 mm/s.

So-called engineering plastics that has high mechanical strength and heat resistance is used as a material of the end cap members 67. Suitable examples thereof include a phenolic resin, polyimide resin, a polyamide resin, a polyamide-imide resin, a PEEK resin, a PES resin, a PPS resin, and an LCP resin.

As illustrated in FIG. 2, in the fixing unit 60, the rotation driving force from a drive motor 90 is transmitted to a shaft 93 via transmission gears 91 and 92, and is transmitted from transmission gears 94 and 95, which are coupled with the shaft 93, to both of the end cap members 67. In this manner, rotation driving force is transmitted from the end cap members 67 to the fixing belt 61, and the end cap members 67 and the fixing belt 61 are driven to rotate in an integrated manner.

The fixing belt 61 directly receives a driving force, from both of the end portions of the fixing belt 61, and rotates in this manner. As such, the fixing belt 61 rotates with stability.

Description of Pressurizing Roller

Referring back to FIG. 3, the pressurizing roller 62 is arranged to face the fixing belt 61 and rotates in an arrow D direction in FIG. 3, driven by the fixing belt 61, at a process speed of, for example, 140 mm/s. A nip portion N (pressurizing portion) is formed in a state where the fixing belt 61 is nipped by the pressurizing roller 62 and the pressing pad 63 and the sheet P that holds the non-fixed toner image passes through the nip portion N such that the non-fixed toner image to which the heat and the pressure are added is fixed onto the sheet P.

The pressurizing roller 62 is configured to have a solid aluminum core (columnar core) 621 with a diameter of, for example, 18 mm, a heat-resistant elastomer layer 622 that is coated by an outer circumferential surface of the core 621, has a thickness of, for example, 5 mm, and is formed of silicone sponge, and a release layer 623 that has a thickness of, for example, 50 μm and is formed of heat-resistant resin coating of carbon-mixed PFA or the like or heat-resistant rubber coating, the core 621, the elastomer layer 622, and the release layer 623 being stacked. The pressing pad 63 is pressed via the fixing belt 61 at a load of, for example, 25 kgf by a pressing spring 68 (refer to FIG. 2).

Description of Pressing Pad

The pressing pad 63 is a block member with a substantially arc-shaped sectional shape that is configured to have a rigid body which is formed of, for example, silicone rubber or fluororubber, and is supported by the frame 64 inside the fixing belt 61. The pressing pad 63 is fixedly arranged over an entire area in the axial direction in an area where the fixing belt 61 is urged by the pressurizing roller 62. The pressing pad 63 is placed to uniformly press the pressurizing roller 62, via the fixing belt 61, in an entire area with a predetermined width at a predetermined load (for example, an average of 10 kgf), and forms the nip portion N.

Description of Temperature Sensor

The temperature sensor 65 is, for example, a thermistor type temperature sensor, and has a temperature detection unit that has a thermistor which is a material whose resistance value is changed by temperature change.

Various thermistors may be used as the thermistor used in the temperature detection unit. Examples thereof include a negative temperature coefficient (NTC) thermistor whose resistance is decreased by a rise in temperature, a positive temperature coefficient (PTC) thermistor whose resistance is increased by a rise in temperature, and a critical temperature resistor (CTR) thermistor whose resistance is decreased by a rise in temperature but whose sensitivity is improved within a specific temperature range.

Temperature information that is detected by the temperature sensor 65 is sent, for example, to the control unit 31. The control unit 31 controls the heater unit 80 based on the temperature information such that the temperature of the fixing belt 61 is within a predetermined range.

Description of Configuration of Heater Unit

Figure 5:
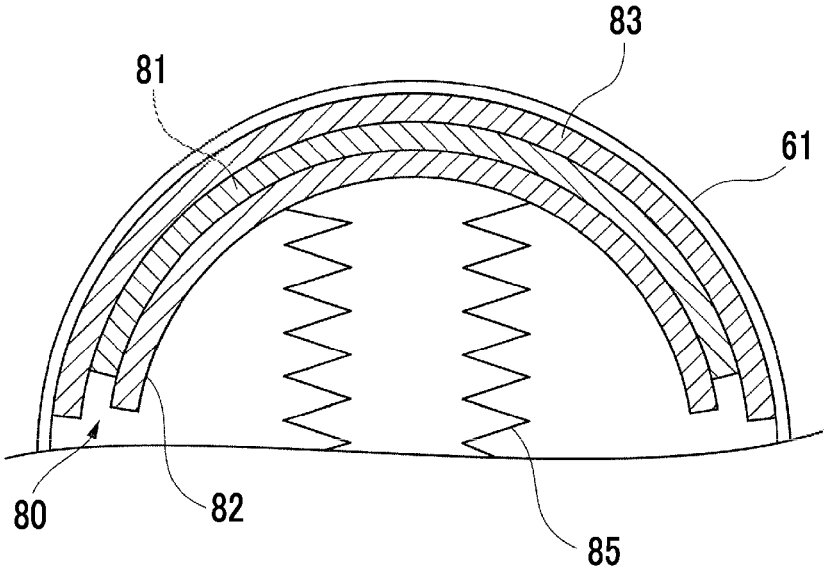
FIG. 5 is a diagram illustrating a configuration of a heater unit of this exemplary embodiment.

FIG. 5 is a diagram illustrating a configuration of the heater unit 80 according to this exemplary embodiment.

As illustrated in FIG. 5, the heater unit 80 has a heater 81 as an example of a heating member that is a heat generating source, a supporting member 82 that defines an arched shape of the heater 81 and supports the heater 81, a thermal diffusion plate 83 as an example of a thermal diffusion member that diffuses heat generated by the heater 81, and a pressing member 85 that presses the heater unit 80 to the fixing belt 61.

The heater unit 80 according to this exemplary embodiment has a structure in which the heater 81 is pinched by the supporting member 82 and the thermal diffusion plate 83.

In this exemplary embodiment, the heater 81 functions as an example of a heating member that contacts with the inner circumferential surface of the fixing belt 61 (refer to FIG. 3) to heat the fixing belt 61.

Figure 6A:
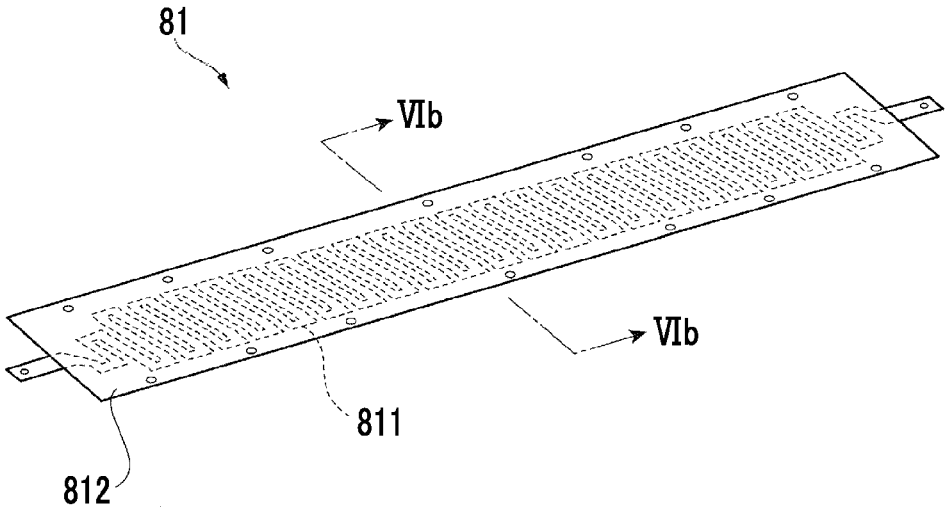
FIGS. 6A and 6B are diagrams illustrating a structure of a heater of this exemplary embodiment.
Figure 6B:
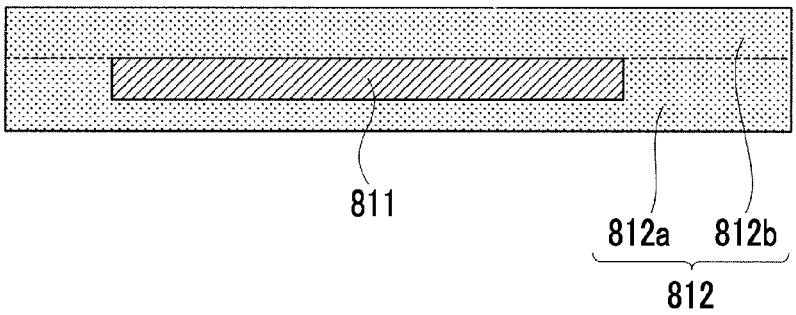

FIGS. 6A and 6B illustrate a structure of the heater 81 according to this exemplary embodiment. FIG. 6A is a perspective diagram illustrating the heater 81, and FIG. 6B is a sectional view taken along line VIb-VIb of the heater 81 illustrated in FIG. 6A.

The heater 81 is a so-called film heater and has flexibility. When actually used, the heater 81 is bent into an arc shape as illustrated in FIG. 5 in a state where the heater 81 is pinched by the supporting member 82 and the thermal diffusion plate 83. However, for ease of understanding of the description, the planar heater 81, prior to the bending into an arc shape, is illustrated in FIGS. 6A and 6B.

As is illustrated in the drawings, the heater 81 according to this exemplary embodiment adopts a structure in which a heat generating layer 811 is pinched by an insulating layer 812.

In this exemplary embodiment, the heat generating layer 811 functions as an example of a heat generating portion whose wiring draws a predetermined pattern. The heat generating layer 811 is formed of a conductive material and is energized to generate heat. In this exemplary embodiment, the heat generating layer 811 is formed of a stainless steel foil with a thickness of, for example, 30 μm. Examples of the stainless steel foil that is used in the heat generating layer 811 include SUS 430 and SUS 304. Any resistant heater other than the stainless steel foil that is energized to generate heat may be used as the heat generating layer 811, examples of which include copper, aluminum, and nickel.

In addition, the heat generating layer 811 draws the predetermined pattern, and thus performs the heat generation in a uniform manner. The heat generating layer 811 according to this exemplary embodiment draws a wavy pattern as illustrated in FIG. 6A, in which a base pattern that is formed to reciprocate in a lateral direction of the heater 81 is connected in a longitudinal direction of the heater 81 by plural times.

The insulating layer 812 is a layer that insulates the heat generating layer 811 and protects the heat generating layer 811 such that no bending or the like occurs in the heat generating layer 811. In this exemplary embodiment, the insulating layer 812 adopts a double layer structure of an insulating layer 812*a* and an insulating layer 812*b*. The heat generating layer 811 is pinched by the insulating layer 812*a* and the insulating layer 812*b* and is subjected to thermocompression such that the heat generating layer 811 is contained in the insulating layer 812. In this case, the insulating layer 812*a* and the insulating layer 812*b* are adhered and integrated.

It is necessary that the insulating layers 812*a* and 812*b* be formed of a material that has insulation properties and excellent heat resistance. In this exemplary embodiment, thermosetting polyimide with a thickness of, for example, 25 μm to 50 μm, is used as the insulating layer 812*a*, and thermoplastic polyimide with a thickness of, for example, 25 μm to 50 μm is used as the insulating layer 812*b*.

Referring back to FIG. 5, the supporting member 82 is arranged on the insulating layer 812*a* side of the heater 81 along the longitudinal direction of the heater 81. The supporting member 82 defines the arch shape of the heater 81.

The supporting member 82 is formed of a material that is excellent in heat resistance and has higher rigidity than the heater 81. In this exemplary embodiment, a stainless steel plate with a thickness of, for example, 0.1 mm is used as the supporting member 82. Examples of the stainless steel material used in the supporting member 82 include SUS 304.

It is preferable that the length of the supporting member 82 along a direction of rotation of the fixing belt 61 be greater than the length of the heater 81 (length of the heater 81 in the lateral direction) along the direction of rotation of the fixing belt 61.

Bending may occur in an end portion of the heater 81 when the length of the supporting member 82 is less than the length of the heater 81 in the lateral direction, for example, when the heater 81 is pressed to the supporting member 82 by the fixing belt 61 and the thermal diffusion plate 83.

The thermal diffusion plate 83 is arranged on the insulating layer 812*b* side of the heater 81 along the longitudinal direction of the heater 81. The thermal diffusion plate 83 diffuses the heat generated by the heat generating layer 811 of the heater 81 and transmits the heat to the fixing belt 61.

It is necessary that the thermal diffusion plate 83 be formed of a material that is excellent in thermal conductivity and excellent in heat resistance. In addition, in this exemplary embodiment, it is preferable that the thermal diffusion plate 83 be formed of a material that has less rigidity than the supporting member 82. In this exemplary embodiment, a stainless steel plate with a thickness of, for example, 0.3 mm is used as the thermal diffusion plate 83. Examples of the stainless steel material used in the thermal diffusion plate 83 include SUS 430.

Herein, it is preferable that the length of the thermal diffusion plate 83 along the direction of rotation of the fixing belt 61 be greater than the length of the heater 81 (length of the heater 81 in the lateral direction) along the direction of rotation of the fixing belt 61.

The end portion of the heater 81, for example, may directly contact with the inner circumferential surface of the fixing belt 61 when the length of the thermal diffusion plate 83 is less than the length of the heater 81 in the lateral direction. In this case, the heat is directly conducted from the heater 81 to the fixing belt 61, and thus the temperature of the fixing belt 61 may rise locally.

The pressing member 85 is configured to have, for example, a coil spring. One end of the pressing member 85 is fixed to the supporting member 82 of the heater unit 80 and the other end of the pressing member 85 contacts with the frame 64 (refer to FIG. 3). In other words, the pressing member 85 is positioned between the frame 64 and the heater unit 80, and presses the heater unit 80 to the fixing belt 61 by using a pressing force that is generated by the pressing member 85. In this manner, the thermal diffusion plate 83 of the heater unit 80 may maintain the contact between the fixing belt 61 and the thermal diffusion plate 83.

Herein, in the heater unit 80 according to this exemplary embodiment, the heater 81 and the thermal diffusion plate 83 are configured to have less rigidity than the supporting member 82. Further, in this exemplary embodiment, the fixing belt 61 is configured to have less rigidity than the heater 81, the thermal diffusion plate 83, and the supporting member 82.

As a result, the adhesion of the heater unit 80 with respect to the fixing belt 61 may be improved in this exemplary embodiment.

Specifically, due to the rigidity relationship described above, the fixing belt 61 is wound around the supporting member 82 via the thermal diffusion plate 83 and the heater 81 when the heater unit 80 is pressed to an inner circumference of the fixing belt 61. In this manner, the fixing belt 61 is pressed to the thermal diffusion plate 83 of the heater unit 80, and thus the adhesion between the inner circumferential surface of the fixing belt 61 and the thermal diffusion plate 83 is improved.

Furthermore, since the fixing belt 61 is wound around the supporting member 82 via the thermal diffusion plate 83 and the heater 81, the heater 81 is pinched between the thermal diffusion plate 83 and the supporting member 82 due to the pressing force of the fixing belt 61. In this manner, the adhesion between the heater 81, and the thermal diffusion plate 83 and the supporting member 82 is improved.

As a result, the heat that is generated in the heater 81 of the heater unit 80 is transmitted well to the thermal diffusion plate 83, and the heat that is transmitted to the thermal diffusion plate 83 is transmitted well to the fixing belt 61 after being diffused by the thermal diffusion plate 83.

In addition, it is preferable that the supporting member 82 be set to have a greater thermal expansion coefficient than the heater 81 and the thermal diffusion plate 83 in the heater unit 80 according to this exemplary embodiment.

Due to the thermal expansion coefficient relationship described above, the supporting member 82 is more deformed through thermal expansion than the heater 81 and the thermal diffusion plate 83 when, for example, the fixing belt 61 is heated and the heater 81 is allowed to generate heat.

As described above herein, the heater 81, the supporting member 82, and the thermal diffusion plate 83 according to this exemplary embodiment have curved shapes to follow the inner circumferential surface of the fixing belt 61. In most cases, the members are deformed in a direction in which the curve is open when the members curved in this manner thermally expand.

Accordingly, the supporting member 82 is deformed such that the curve is more open than the curves of the heater 81 and the thermal diffusion plate 83 since the heater 81, the supporting member 82, and the thermal diffusion plate 83 have the above-described thermal expansion coefficient relationship.

As a result, the heater 81 and the thermal diffusion plate 83 are pressed to the fixing belt 61 side by the supporting member 82. In this manner, the adhesion between the inner circumferential surface of the fixing belt 61 and the thermal diffusion plate 83 of the heater unit 80 is improved and the heat of the heater unit 80 that is generated by the heater 81 is transmitted better to the fixing belt 61 via the thermal diffusion plate 83 compared to when this configuration is not adopted.

Figure 8:
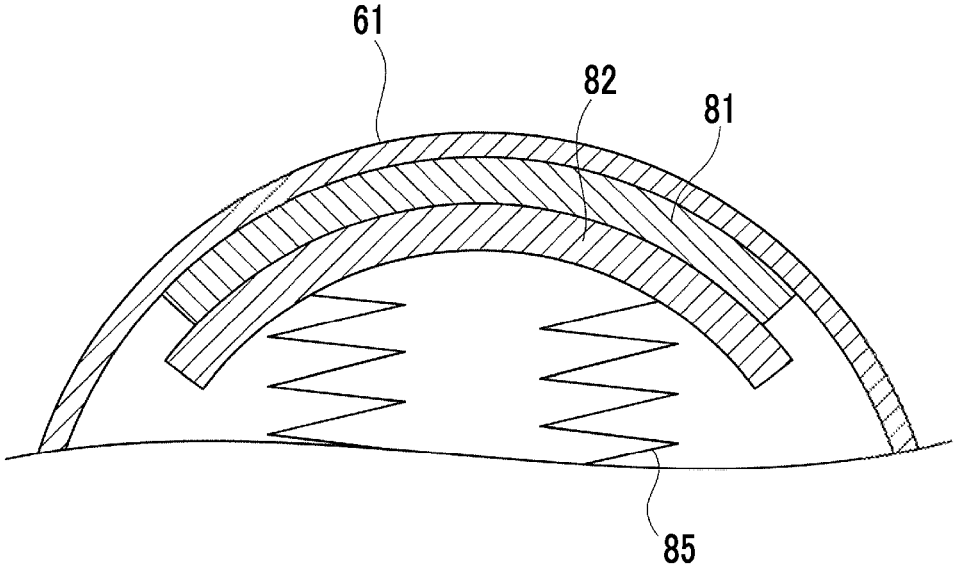
FIG. 8 is a diagram illustrating a configuration of a heater unit of the related art.

FIG. 8 is a diagram illustrating a configuration of a heater unit of the related art.

The heater unit of the related art that is illustrated in FIG. 8 has the same configuration as the heater unit 80 of this exemplary embodiment illustrated in FIG. 5 except that the heater unit of the related art does not have the thermal diffusion plate 83 (refer to FIG. 5). In other words, the heater unit of the related art illustrated in FIG. 8 has the heater 81, the supporting member 82, and the pressing member 85, and is arranged such that the heater 81 contacts with the inner circumferential surface of the fixing belt 61.

As described above, the heat generating layer 811 of the heater 81 draws a pattern. As a result, uneven heat generation corresponding to the pattern of the heat generating layer 811 occurs in the heater 81 when the heat generating layer 811 generates heat.

For example, in the example illustrated in FIG. 6A, the heat generating layer 811 of the heater 81 draws a pattern in which the base pattern that is formed to reciprocate in the lateral direction of the heater 81 is connected by plural times in the longitudinal direction of the heater 81. When, for example, a central portion of the heater 81 in the lateral direction is viewed along the longitudinal direction, an area where the heat generating layer 811 is present and an area where the heat generating layer 811 is absent are alternately arranged.

Accordingly, when the heat generating layer 811 is allowed to generate heat, a heat generation distribution in which an area with a large amount of heat generation and an area with a small amount of heat generation are alternately arranged occurs along the longitudinal direction of the heater 81.

The heater unit of the related art does not have the thermal diffusion plate 83 (refer to FIG. 5), and thus the heater 81 directly contacts with the inner circumferential surface of the fixing belt 61 as illustrated in FIG. 8.

As a result, a temperature distribution corresponding to the heat generation distribution of the heater 81 is likely to occur in the fixing belt 61 when the fixing belt 61 and the like is heated by using the heater unit of the related art.

Figure 9:
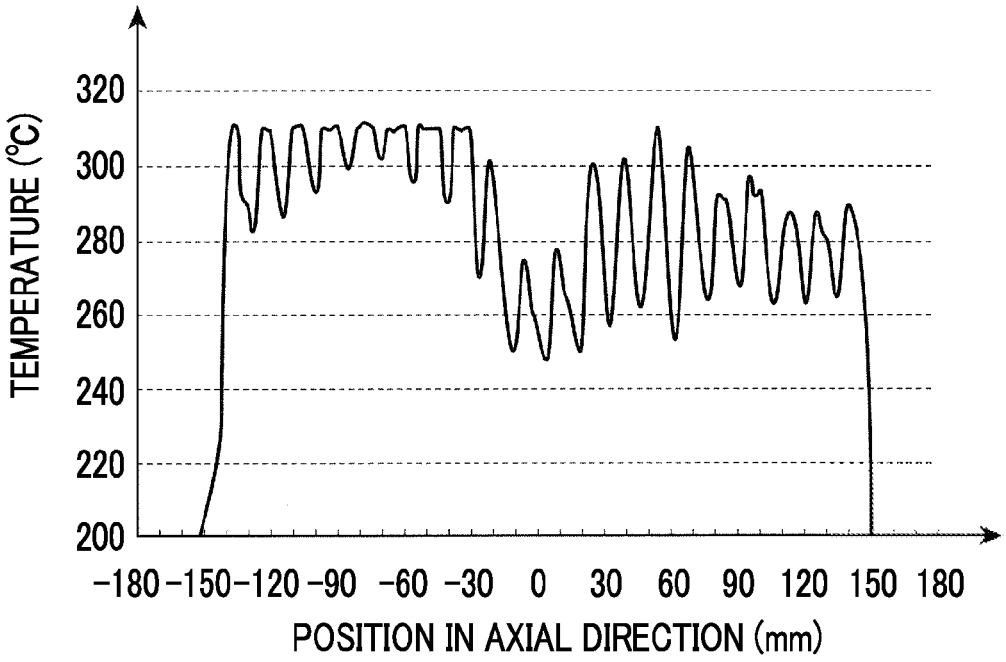
FIG. 9 is a diagram illustrating a temperature distribution on a fixing belt outer surface at a time when a fixing belt is heated by using the heater unit of the related art.

FIG. 9 is a diagram illustrating the temperature distribution on an outer surface of the fixing belt 61 at a time when the fixing belt 61 is heated by using the heater unit of the related art. FIG. 9 illustrates the temperature distribution of the fixing belt 61 in an upstream portion of the nip portion N (refer to FIG. 3).

As illustrated in FIG. 9, the temperature distribution (temperature unevenness) corresponding to the pattern of the heat generating layer 811 of the heater 81 occurs along a direction of a rotation axis of the fixing belt 61 when the fixing belt 61 is heated by using the heater unit of the related art. Specifically, the temperature unevenness occurs such that the area with a high temperature and the area with a low temperature are alternately arranged along the direction of the rotation of axis of the fixing belt 61.

When the temperature unevenness occurs in this manner on the outer surface of the fixing belt 61, gross irregularities or the like caused by the temperature unevenness occur on the image fixed on the recording material and the quality of the image that is formed may be reduced.

In contrast, the thermal diffusion plate 83 is disposed in the heater unit 80 according to this exemplary embodiment as described above, and thus the temperature unevenness on the outer surface of the fixing belt 61 is suppressed.

Figure 7:
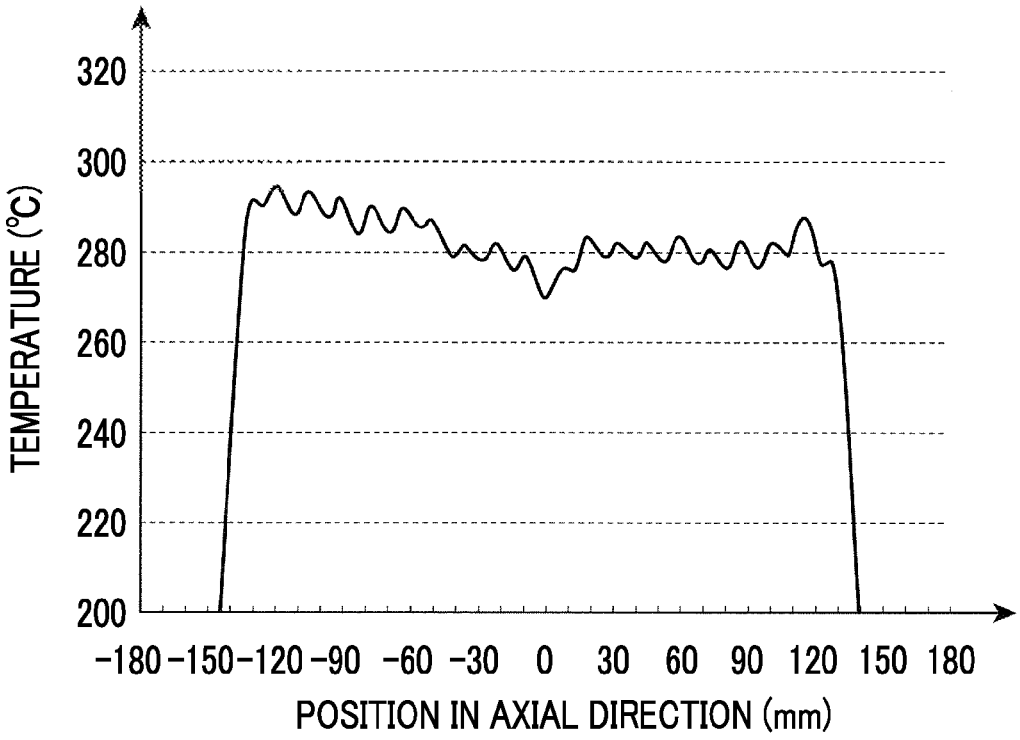
FIG. 7 is a diagram illustrating a temperature distribution on a fixing belt outer surface at a time when the fixing belt is heated by using the heater unit of this exemplary embodiment.

FIG. 7 is a diagram illustrating the temperature distribution on the outer surface of the fixing belt 61 at a time when the fixing belt 61 is heated by using the heater unit 80 according to this exemplary embodiment. FIG. 7 illustrates the temperature distribution of the fixing belt 61 on an upstream side of the nip portion N (refer to FIG. 3).

As illustrated in FIG. 5, the thermal diffusion plate 83 is disposed on the heater 81 in the heater unit 80 and the thermal diffusion plate 83 contacts with the inner circumferential surface of the fixing belt 61 in this exemplary embodiment. In this manner, the heat that is generated by the heater 81 is conducted to the thermal diffusion plate 83. Since the thermal diffusion plate 83 is formed of a material with excellent thermal conductivity as described above, the heat from the heater 81 is diffused in a plane direction of the thermal diffusion plate 83. In other words, the heat from the heater 81 is conducted to the fixing belt 61 after being diffused by the thermal diffusion plate 83 in this exemplary embodiment.

In particular, as described above, the fixing belt 61, the heater 81, and the thermal diffusion plate 83 are configured to have less rigidity than the supporting member 82 in the heater unit 80 according to this exemplary embodiment. As such, the adhesion between the inner circumferential surface of the fixing belt 61 and the thermal diffusion plate 83 of the heater unit 80 is improved, and the heat that is transmitted from the heater 81 to the thermal diffusion plate 83 is transmitted well to the fixing belt 61.

As a result, compared to the example of the related art illustrated in FIG. 9, the temperature unevenness on the outer surface of the fixing belt 61 may be suppressed as illustrated in FIG. 7 in this exemplary embodiment.

Since the temperature unevenness in the fixing belt 61 is suppressed in this exemplary embodiment, the gross irregularities in, for example, the image that is formed on the recording material may be suppressed and the reduction of the quality of the image may be suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member configured to fix a toner image onto a recording material;

a pressurizing member configured to form a pressurizing portion, in cooperation with the fixing member, through which the recording material holding a non-fixed toner image passes;

a heating member that includes a heat generating portion having a predetermined pattern shape, wherein the heating member is configured to be energized to generate heat and thereby heat the fixing member;

a supporting member configured to support the heating member along an inner circumferential surface of the fixing member; and a thermal diffusion member that faces the supporting member, wherein the heating member is disposed between the thermal diffusion member and the supporting member, wherein the thermal diffusion member is configured to diffuse heat from the heating member and conduct the heat to the fixing member, and wherein the fixing member, the heating member, and the thermal diffusion member are formed of a material having less rigidity than the supporting member.

2. The fixing device according to claim 1, wherein the fixing member comprises a belt member including abuse material layer and a release layer coated on the base material layer.

3. The fixing device according to claim 1, wherein the supporting member is longer than the heating member along a direction of rotation of the fixing member.

4. A fixing device comprising:

a fixing member configured to fix a toner image onto a recording material;

a pressurizing member configured to forma pressurizing portion, in cooperation with the fixing member, through which the recording material holding a non-fixed toner image passes;

a heating member that includes a heat generating portion having a predetermined pattern shape, wherein the heating member is configured to be energized to generate heat and thereby heat the fixing member;

a supporting member configured to support the heating member along an inner circumferential surface of the fixing member; and a thermal diffusion member that faces the supporting member, wherein the heating member is disposed between the thermal diffusion member and the supporting member, wherein the thermal diffusion member is configured to diffuse heat from the heating member and conduct the heat to the fixing member, and wherein the supporting member is formed of a material having a larger thermal expansion coefficient than the heating member and the thermal diffusion member.

5. An image forming apparatus comprising:

a toner image forming unit configured to form a toner image;

a transfer portion configured to transfer the toner image to a recording material;

a fixing member configured to fix the toner image onto the recording material;

a pressurizing member configured to form a pressurizing portion, in cooperation with the fixing member, through which the recording material holding a non-fixed toner image passes;

a heating member that includes a heat generating portion having a predetermined pattern shape, wherein the heating member is configured to be energized to generate heat and thereby heat the fixing member;

a supporting member configured to support the heating member along an inner circumferential surface of the fixing member; and a thermal diffusion member that faces the supporting member, wherein the heating member is disposed between the thermal diffusion member and the supporting member, wherein the thermal diffusion member is configured to diffuse heat from the heating member and conduct the heat to the fixing member, and wherein the fixing member, the heating member, and the thermal diffusion member are formed of a material having less rigidity than the supporting member.

6. The image forming apparatus according to claim 5, wherein the fixing member comprises a belt member including a base material layer and a release layer coated on the base material layer.

7. An image forming apparatus comprising:

a toner image forming unit configured to form a toner image;

a transfer portion configured to transfer the toner image to a recording material;

a fixing member configured to fix the toner image onto the recording material;

a pressurizing member configured to form a pressurizing portion, in cooperation with the fixing member, through which the recording material holding a non-fixed toner image passes;

a heating member that includes a heat generating portion having a predetermined pattern shape, wherein the heating member is configured to be energized to generate heat and thereby heat the fixing member;

a supporting member configured to support the heating member along an inner circumferential surface of the fixing member; and a thermal diffusion member that faces the supporting member, wherein the heating member is disposed between the thermal diffusion member and the supporting member, wherein the thermal diffusion member is configured to diffuse heat from the heating member and conduct the heat to the fixing member, and wherein the supporting member is formed of a material having a larger thermal expansion coefficient than the heating member and the thermal diffusion member.

* * * * *